US009151167B2

(12) United States Patent
Zemitis et al.

(10) Patent No.: US 9,151,167 B2
(45) Date of Patent: Oct. 6, 2015

(54) TURBINE ASSEMBLY

(75) Inventors: William Scott Zemitis, Simpsonville, SC (US); Christopher Michael Penny, Greer, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 800 days.

(21) Appl. No.: 13/370,949

(22) Filed: Feb. 10, 2012

(65) Prior Publication Data

US 2013/0209253 A1 Aug. 15, 2013

(51) Int. Cl.
*F01D 17/00* (2006.01)
*F01D 5/30* (2006.01)
*F01D 5/26* (2006.01)

(52) U.S. Cl.
CPC ..... *F01D 5/3007* (2013.01); *F01D 5/26* (2013.01)

(58) Field of Classification Search
CPC ..... F01D 5/3007; F01D 5/3023; F01D 5/303; F01D 5/3038; F01D 5/26
USPC ..... 415/1; 416/219 A, 219 R
See application file for complete search history.

(56) References Cited

U.S. PATENT DOCUMENTS 5,567,116 A 10/1996 Bourcier
6,814,543 B2 11/2004 Barb et al.
7,252,481 B2 * 8/2007 Stone ..... 416/239
7,419,361 B1 9/2008 Byam et al.
7,419,362 B2 * 9/2008 Snook ..... 416/219 R
7,438,532 B2 10/2008 Zemitis
7,476,083 B2 1/2009 Snook et al.
7,476,084 B1 1/2009 Chan et al.
7,476,085 B2 1/2009 Mohr et al.
2008/0101937 A1 5/2008 Zemitis
2009/0208339 A1 8/2009 Cherolis

FOREIGN PATENT DOCUMENTS

JP S63 97803 A 4/1988
JP S63 138403 U 9/1988

OTHER PUBLICATIONS

Search Report and Written Opinion from corresponding EP Application No. 13154704, dated Jul. 1, 2013.

* cited by examiner

*Primary Examiner* — Igor Kershteyn

(57) ABSTRACT

According to one aspect of the invention, a turbine assembly includes an airfoil extending from a blade and a dovetail located on a lower portion of the blade, wherein the dovetail has a dovetail contact surface. The turbine assembly also includes a member with a slot configured to couple to the airfoil via the dovetail, the slot having a slot contact surface to contact the dovetail contact surface, wherein the dovetail contact surface is reduced by a relief to alter a fundamental frequency of an assembly of the blade and member.

19 Claims, 3 Drawing Sheets

TURBINE ASSEMBLY

BACKGROUND OF THE INVENTION

The subject matter disclosed herein relates to rotating and stationary components of turbomachinery and, more particularly, to a blade and disk dovetail design for turbine systems.

Certain turbine rotor disks include a plurality of circumferentially spaced dovetail slots about the outer periphery of the disk. Each of the dovetail slots receives a blade formed with an airfoil portion and a blade dovetail having a male portion complementary to the female portion of the dovetail slots. The blade dovetail is received by the dovetail slot in an axial direction.

During operation of the turbine, movement of certain components and flow of compressed air and hot gas through the turbine can cause vibration in the turbine system. For example, the vibration of rotating blades can be driven by air or gas flowing through adjacent static vanes. Specifically, during operation of the turbine system, driving frequencies are caused by pulses formed as fluid passes through blades in the compressor or turbine. It is desirable for blades to be designed such that their fundamental natural frequencies either avoid the driving frequencies or can withstand the vibration caused by them, otherwise wear, high cycle fatigue, and other damage to components can occur. Repair and/or replacement of components due to vibration induced fatigue can be costly and time consuming

BRIEF DESCRIPTION OF THE INVENTION

According to one aspect of the invention, a turbine assembly includes an airfoil extending from a blade and a dovetail located on a lower portion of the blade, wherein the dovetail has a dovetail contact surface. The turbine assembly also includes a member with a slot configured to couple to the airfoil via the dovetail, the slot having a slot contact surface to contact the dovetail contact surface, wherein the dovetail contact surface is reduced by a relief to alter a fundamental frequency of an assembly of the blade and member.

According to another aspect of the invention, a method for altering a fundamental frequency of a turbine assembly includes flowing hot gas across an airfoil extending from a blade, the blade coupled to a rotor disk by a dovetail on the blade and a slot on the rotor disk and altering a fundamental frequency of an assembly of the rotor disk and blade via a reduced area of contact between a dovetail contact surface and a slot contact surface of the slot.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 2:
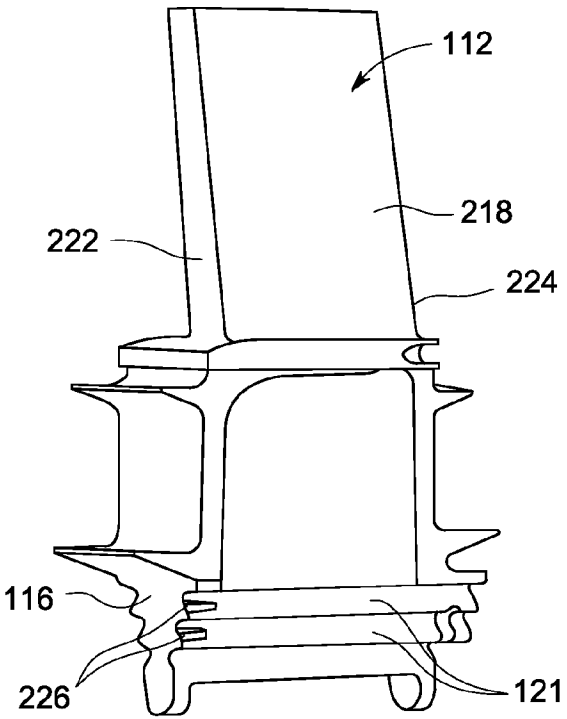
FIG. 2 is a perspective view of the turbine blade shown in FIG. 1.
Figure 1:
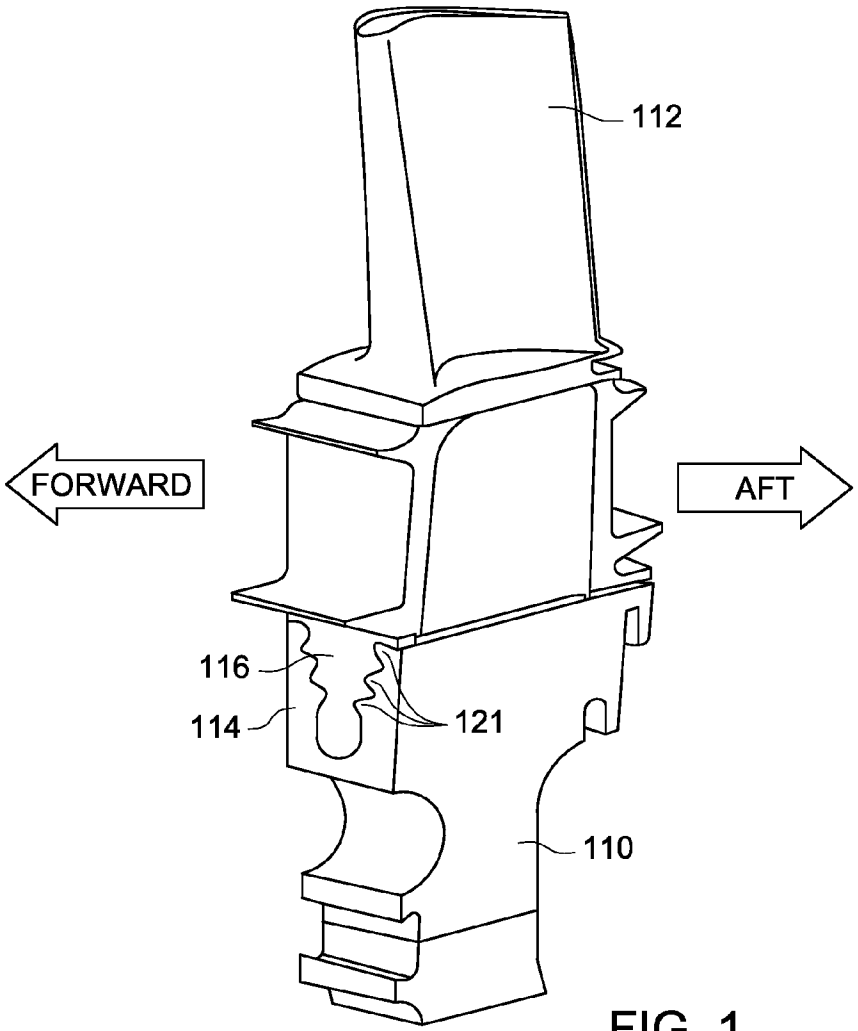
FIG. 1 is a perspective view of a turbine disk segment and a turbine blade according to an embodiment.

FIG. 1 is a perspective view of an exemplary turbine disk segment 110 in which a turbine blade 112 is secured. Embodiments may include applications for gas turbines, steam turbines, axial flow compressors, or other devices involving a plurality of rotating blades secured by dovetails. The disk 110 includes a dovetail slot 114 that receives a correspondingly shaped blade dovetail 116 to secure the blade 112 to the disk 110. In an embodiment, the blade dovetail 116 has three tangs 121 to retain the blade 112 in the dovetail slot 114. Embodiments may include as few as one and as many as eight or more tangs 121. FIG. 2 shows a bottom section of the blade 112 including an airfoil 218 and the blade dovetail 116. In an embodiment, a hot gas flows across the airfoil 218, thereby creating a pressure side 222 (i.e., leading edge) and a suction side 224 (i.e., trailing edge) of the blade 112. As described in further detail below, a plurality of reliefs 226 are formed in the tangs 121 to alter a fundamental frequency of an assembly of the blade 112 and disk segment 110 (also referred to as "member" or "turbine member"). The fundamental frequency is altered or shifted away from one or more driving frequencies of the turbine system, thereby reducing incidence of wear and fatigue for the components.

The dovetail slots 114 are typically termed "axial entry" slots in that the dovetails 116 of the blades 112 are inserted into the dovetail slots 114 in a generally axial direction, i.e., generally parallel but skewed to the axis of the disk 110. The features described herein are generally applicable to any airfoil and disk interface. The structure depicted in FIGS. 1 and 2 is merely representative of many different disk and blade designs across different classes of turbines. In an embodiment, reliefs 226 are formed by any suitable method for removal of material from the dovetail 116 to form a recess in the surface such as casting, cutting and machining. For example, the reliefs 226 may include a cut or machined recess in the dovetail surface that produces a gradual or gentle rounded slope in the recess.

As used herein, "downstream" and "upstream" are terms that indicate a direction relative to the flow of working fluid through the turbine. As such, the term "downstream" refers to a direction that generally corresponds to the direction of the flow of working fluid, and the term "upstream" generally refers to the direction that is opposite of the direction of flow of working fluid. The term "radial" refers to movement or position perpendicular to an axis or center line. It may be useful to describe parts that are at differing radial positions with regard to an axis. In this case, if a first component resides closer to the axis than a second component, it may be stated herein that the first component is "radially inward" of the second component. If, on the other hand, the first component resides further from the axis than the second component, it can be stated herein that the first component is "radially outward" or "outboard" of the second component. The term "axial" refers to movement or position parallel to an axis. Finally, the term "circumferential" refers to movement or position around an axis. Although the following discussion primarily focuses on gas turbines, the concepts discussed are not limited to gas turbines and may apply to any suitable machinery, including steam turbines. Accordingly, the discussion herein is directed to gas turbine embodiments, but may apply to other turbine systems.

Figure 3:
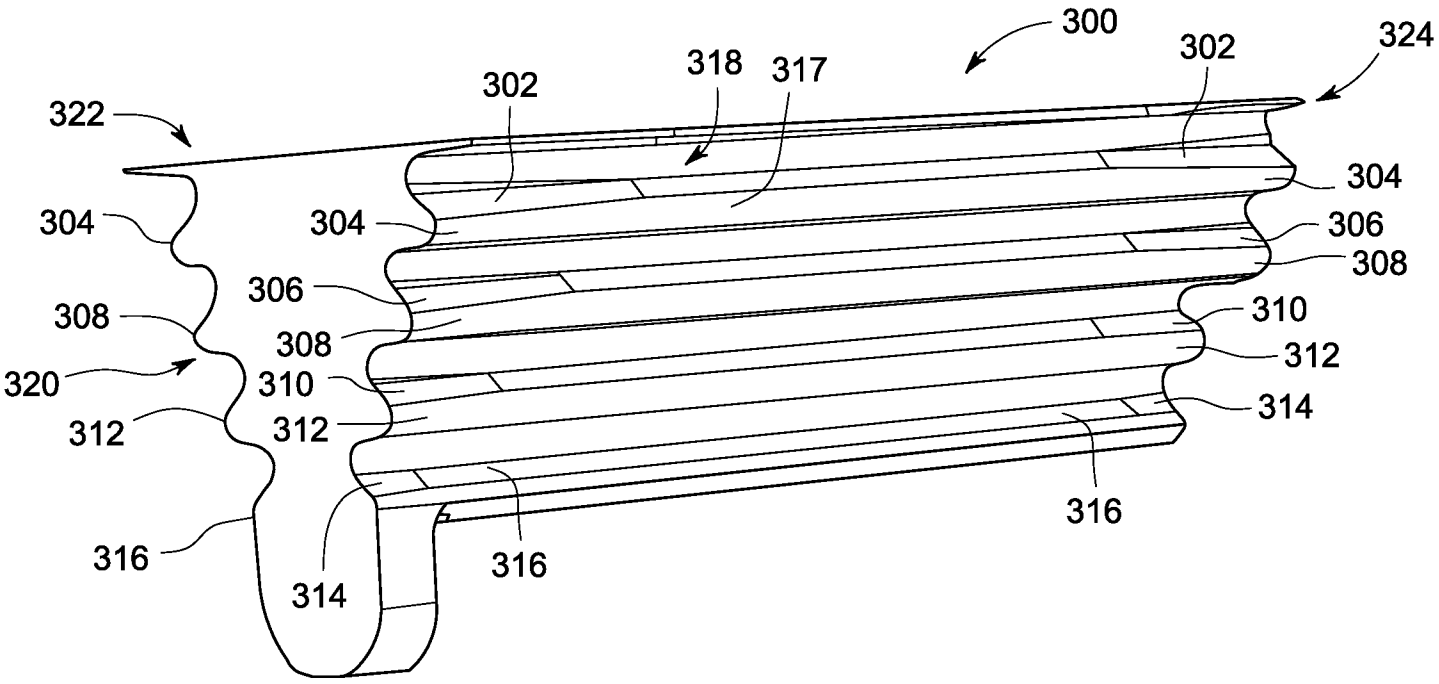
FIG. 3 is a detailed perspective view of a dovetail portion of a turbine blade according to an embodiment.

FIG. 3 is a perspective view of a portion of an embodiment of a blade including a dovetail 300. The dovetail 300 includes reliefs 302, 306, 310 and 314 formed in tangs 304, 308, 312 and 316, respectively. The reliefs remove material from the dovetail 300, thereby reducing an area of a contact surface 317 that is in contact with a receiving dovetail slot, such as a slot formed in a turbine or compressor disk. In an embodiment, reliefs are formed in a first lateral side 318 and a second lateral side 320 of the dovetail 300. In addition, reliefs are formed in a leading edge 322 (i.e., pressure side) and a trailing edge 324 (i.e., suction side) of the dovetail 300. Various configurations of the dovetail, tangs and reliefs are contemplated. In embodiments, one or more reliefs may be formed in as few as one tang or as many as all tangs 304, 308, 312 and 316. Further, one or more reliefs may be formed one or both of the leading edge 322 and trailing edge 324. In addition, one or more reliefs may be formed in one or both of the first lateral side 318 and second lateral side 320 of the dovetail 300.

In one embodiment, the reduced contact surface 317 provided by the reliefs 302, 306, 310 and 314 alters a fundamental frequency of an assembly of the blade and receiving member (e.g., turbine disk segment or compressor casing). Thus, the fundamental frequency of the assembly is shifted away from one or more driving frequencies of the turbine system, thereby reducing fatigue and improving the life of the components. In one embodiment, one or more of the reliefs shift the fundamental frequency of the blade and disk assembly by 1-2% or more, thus shifting the fundamental frequency away from driving frequencies. In embodiments, the reliefs may be one of a plurality of techniques used to alter the fundamental frequency of the blade and disk segment assembly. The reliefs 302, 306, 310 and 314 may be formed by any suitable method, such as by machining the dovetail after it is cast. For example, the blade and dovetail may be cast from an alloy and tested to determine the fundamental frequency of the blade and disk segment assembly, where the number, location and size of the reliefs are determined by the tests and subsequently formed by machining the dovetail.

Figure 4:
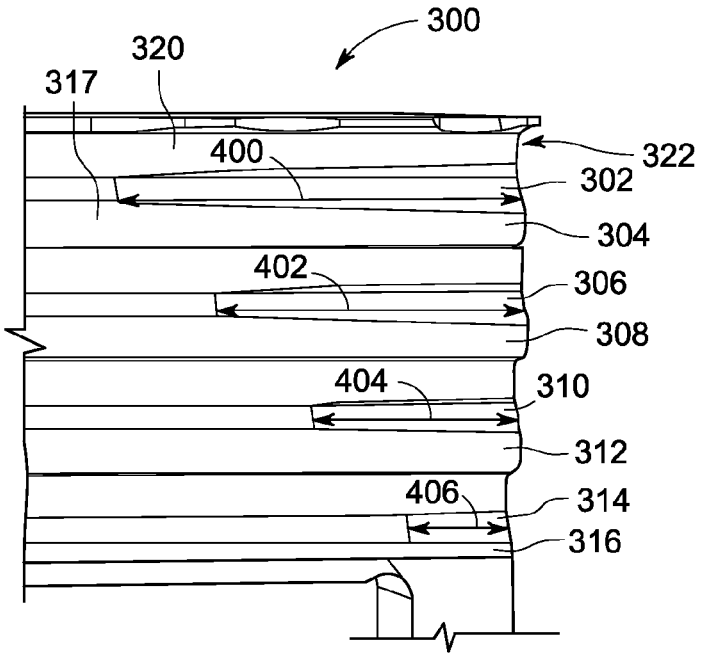
FIG. 4 is a detailed side view of a portion of the dovetail shown in FIG. 3.

FIG. 4 is a detailed side view of a portion of the exemplary dovetail 300 shown in FIG. 3. The illustrated view shows the second lateral side 320 of the dovetail 300 in detail. As depicted, the relief 302 has a first axial length 400, the relief 306 has a second axial length 402, the relief 310 has a third axial length 404 and the relief 314 has a fourth axial length 406. In an embodiment, the dimension of axial lengths 400, 402, 404 and 406 are different. In another embodiment, one or more of the axial lengths 400, 402, 404 and 406 are the same dimension. The length, cut depth (i.e., lateral depth of cut into the surface 317) and location of the one or more reliefs may be altered depending on the application and desired changes to the fundamental frequency for the blade and receiving member.

Figure 5:
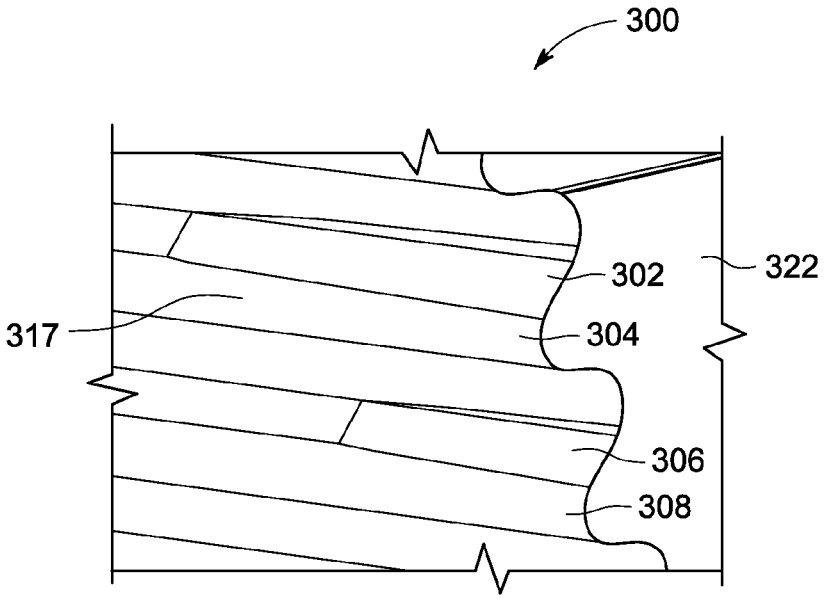
FIG. 5 is a detailed view of a portion of the dovetail shown in FIGS. 3 and 4.

FIG. 5 is a detailed view of a portion of the exemplary dovetail 300 shown in FIGS. 3 and 4. The illustration shows the reliefs 302 and 306 formed in the tangs 304 and 308 of the dovetail 300. The reliefs 302 and 306 reduce the contact surface 317 to alter a fundamental frequency for the blade (including the dovetail) and the receiving member (e.g., disk) assembly. Specifically, the area of contact between contact surface 317 of dovetail 300 and the contact surface of the receiving dovetail slot is reduced by the reliefs 302 and 306. In embodiments, the area of contact between the dovetail 300 and the dovetail slot may be reduced by any suitable method, such as cuts, grooves and recesses formed in the contact surface of the dovetail and/or dovetail slot. The depicted embodiment of the blade dovetail and receiving member improve the life span of the receiving member and/or blade and increase robustness of the assembly by altering a fundamental frequency of the assembly away from a driving frequency of the turbine system.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A turbine assembly comprising:

an airfoil extending from a blade;

a dovetail having a flat trailing edge located on a lower portion of the blade, wherein the dovetail has a dovetail contact surface; and a member with a slot configured to couple to the airfoil via the dovetail, the slot having a slot contact surface to contact the dovetail contact surface, wherein the dovetail contact surface is reduced by a relief at at least the trailing edge of the dovetail to alter a fundamental frequency of an assembly of the blade and member.

2. The turbine assembly of claim 1, wherein the dovetail contact surface is reduced by a plurality of reliefs extending to the trailing edge of the dovetail.

3. The turbine assembly of claim 2, wherein the plurality of reliefs are located proximate a leading edge and the trailing edge of the dovetail.

4. The turbine assembly of claim 2, wherein the plurality of reliefs comprise reliefs of a plurality of different axial lengths.

5. The turbine assembly of claim 2, wherein the dovetail comprises a plurality of tangs, wherein each of the plurality of reliefs is formed in each of the plurality of tangs.

6. The turbine assembly of claim 1, wherein the relief shifts the fundamental frequency away from a driving frequency formed when the turbine assembly is in operation.

7. The turbine assembly of claim 1, wherein the member comprises a turbine disk segment.

8. A turbine assembly comprising:

an airfoil extending from a blade;

a dovetail having a flat trailing edge located on a lower portion of the blade, wherein the dovetail has a dovetail contact surface; and a turbine disk with a slot configured to couple to the airfoil via the dovetail, the slot having a slot contact surface to contact the dovetail contact surface, wherein a fundamental frequency of an assembly of the blade and turbine disk is altered by a reduced area of contact between the slot contact surface and the dovetail contact surface at at least the trailing edge of the dovetail.

9. The turbine assembly of claim 8, wherein the dovetail contact surface is reduced by a relief.

10. The turbine assembly of claim 9, wherein the relief shifts the fundamental frequency away from a driving frequency formed when the turbine assembly is in operation.

11. The turbine assembly of claim 8, wherein the dovetail contact surface is reduced by a plurality of reliefs extending to the trailing edge of the dovetail.

12. The turbine assembly of claim 11, wherein the plurality of reliefs are located proximate a leading edge and trailing edge of the dovetail.

13. The turbine assembly of claim 11, wherein the plurality of reliefs comprise reliefs of a plurality of different axial lengths.

14. The turbine assembly of claim 11, wherein the dovetail comprises a plurality of tangs, wherein each of the plurality of reliefs is formed in each of the plurality of tangs.

15. A method for altering a fundamental frequency of a turbine assembly, the method comprising:

flowing fluid across an airfoil extending from a blade, the blade coupled to a rotor disk by a dovetail on the blade and a slot on the rotor disk, wherein the dovetail includes a flat trailing edge; and altering a fundamental frequency of an assembly of the rotor disk and blade via a reduced area of contact between a dovetail contact surface and a slot contact surface of the slot at at least the trailing edge of the dovetail.

16. The method of claim 15, wherein area of contact is reduced by a relief on the dovetail contact surface.

17. The method of claim 16, wherein altering the fundamental frequency comprises shifting the fundamental frequency away from a driving frequency formed when the turbine assembly is in operation.

18. The method of claim 15, wherein the dovetail contact surface is reduced by a plurality of reliefs.

19. The method of claim 18, wherein the plurality of reliefs are located proximate a leading edge and trailing edge of the dovetail.

* * * * *